United States Patent [19]

Van Doren

[11] 4,181,286

[45] Jan. 1, 1980

[54] REINFORCED PLASTIC MOLD FOR CONCRETE PANELS

[76] Inventor: David A. Van Doren, P.O. Box 1008, Hays, Kans. 67601

[21] Appl. No.: 885,174

[22] Filed: Mar. 10, 1978

Related U.S. Application Data

[63] Continuation-in-part of Ser. No. 782,175, Mar. 28, 1977, abandoned.

[51] Int. Cl.[2] ..... B28B 7/06

[52] U.S. Cl. ..... 249/82; 249/111; 249/134; 249/165; 249/167; 249/168; 249/172

[58] Field of Search ..... 249/82, 127, 134, 163-172, 249/189, 194, 219 R, 111; 425/DIG. 44; 220/62, 337, 339

[56] References Cited

U.S. PATENT DOCUMENTS

| | | | |
|---|---|---|---|
| 2,266,007 | 12/1941 | Copeman | 249/134 |
| 2,924,962 | 2/1960 | Nettle | 249/13 |
| 3,246,828 | 4/1966 | Branscum et al. | 220/62 |
| 3,317,178 | 5/1967 | Kreier, Jr. | 249/134 |
| 3,330,437 | 7/1967 | Bellamy | 220/62 |
| 3,380,703 | 4/1968 | Zastrow | 249/172 |
| 3,930,633 | 1/1976 | Wolf | 249/165 |
| 4,017,051 | 4/1977 | Scott et al. | 249/134 |

FOREIGN PATENT DOCUMENTS

| | | | |
|---|---|---|---|
| 135680 | 10/1929 | Switzerland | 249/169 |

*Primary Examiner*—John McQuade
*Attorney, Agent, or Firm*—D. A. N. Chase

[57] ABSTRACT

A mold especially adapted for forming precast, waffle-shaped concrete panels employs a one-piece mold body of plastic sheet material to provide a reusable mold structure that may be rapidly stripped and reset. Each corner of the mold body is open; thus, the sides of the mold present pliable flaps due to the inherent flexibility of the sheet material and are swung outwardly after molding is completed in order to release the molded product. External reinforcing members on the sides maintain the same rigid and true during the molding process. The corners are held closed by simple locking devices which are readily released for stripping. Raised portions in the mold body form the characteristic voids in the molded waffle product, and are reinforced and rigidified by a foam filler. Other features include longitudinally extending expansion joints between the mold body and reinforcing members, holdups on the pliable sides of the precasting mold, and the provision of built-in rebar supports which also form notches in the webs of the molded waffle product that serve as electrical and plumbing raceways.

21 Claims, 13 Drawing Figures

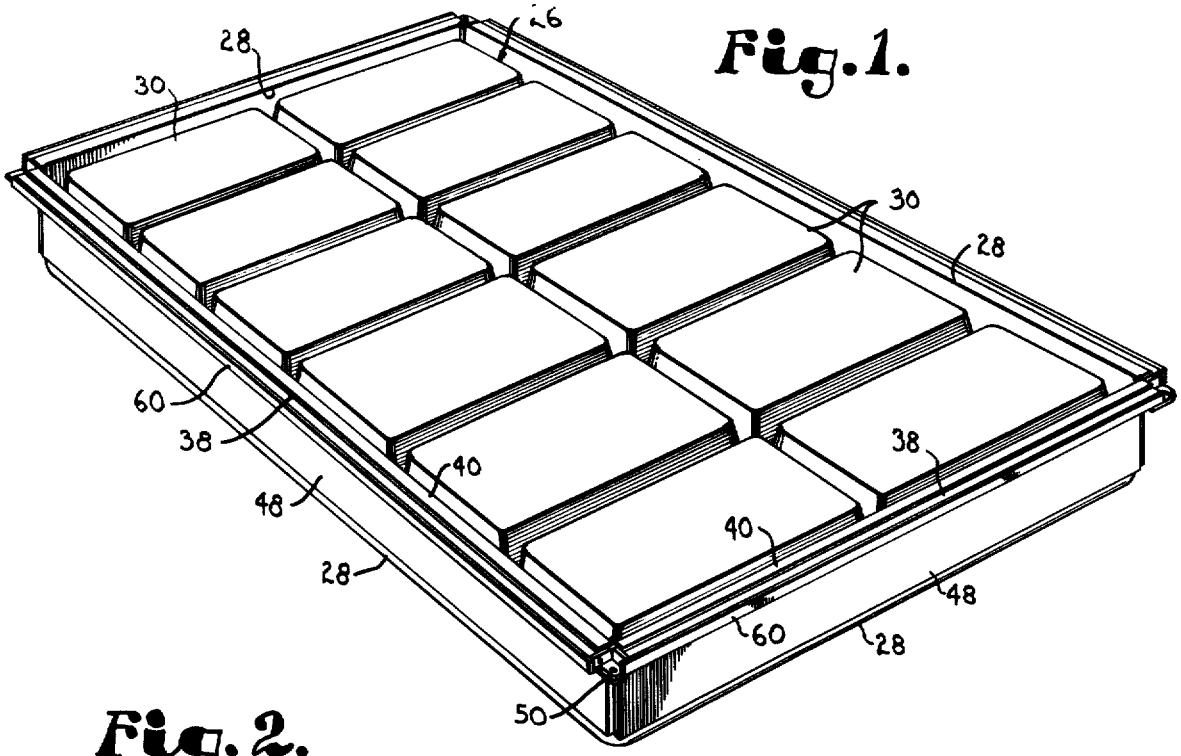
Fig. 1.
Fig. 2.
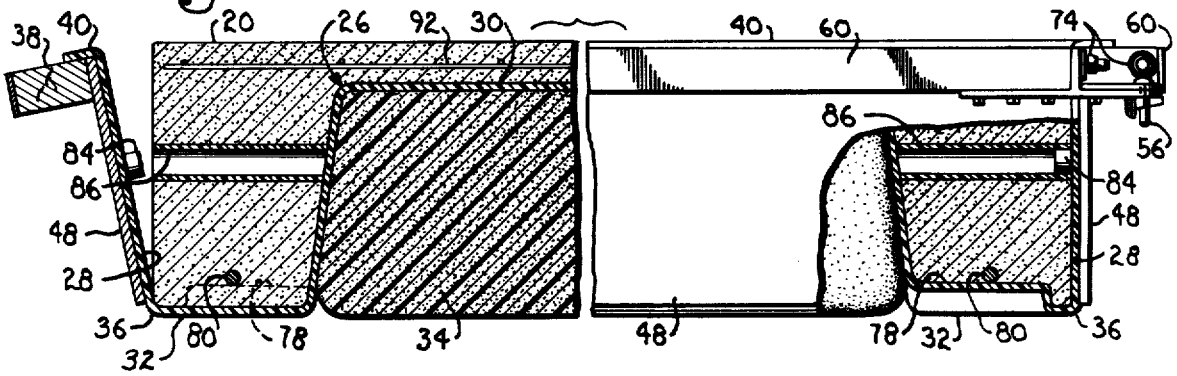
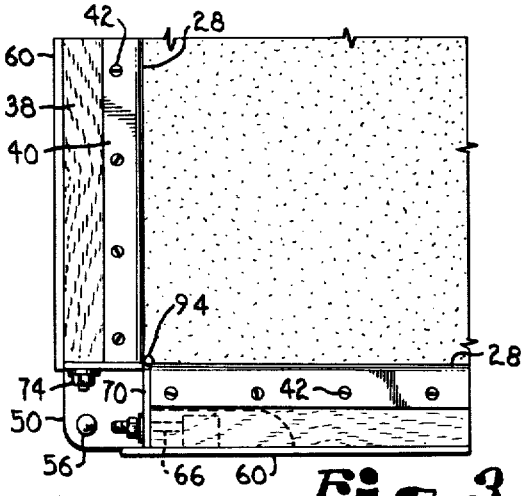
Fig. 3.
Fig. 7.
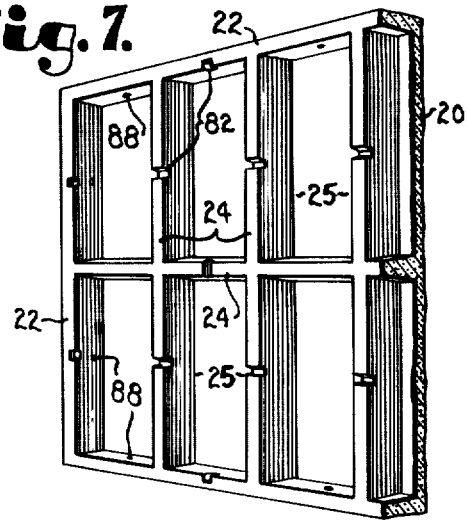

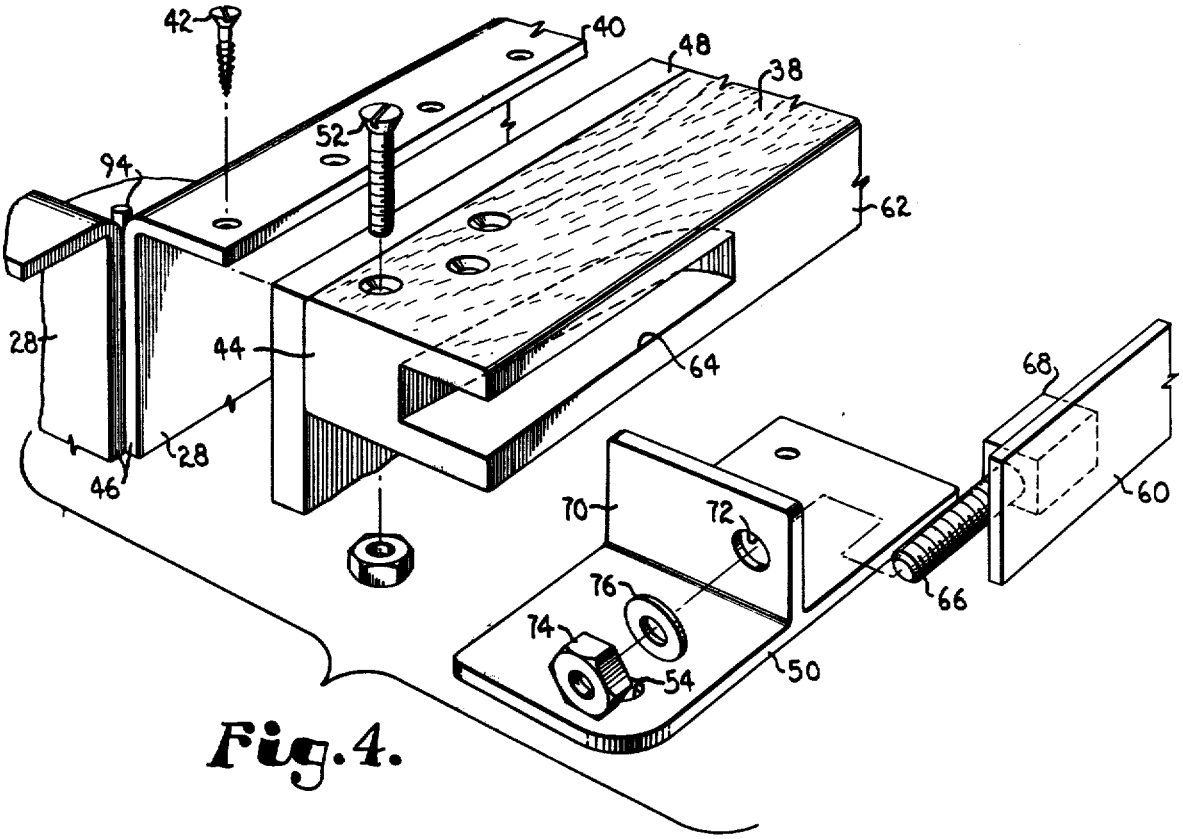
Fig. 4.
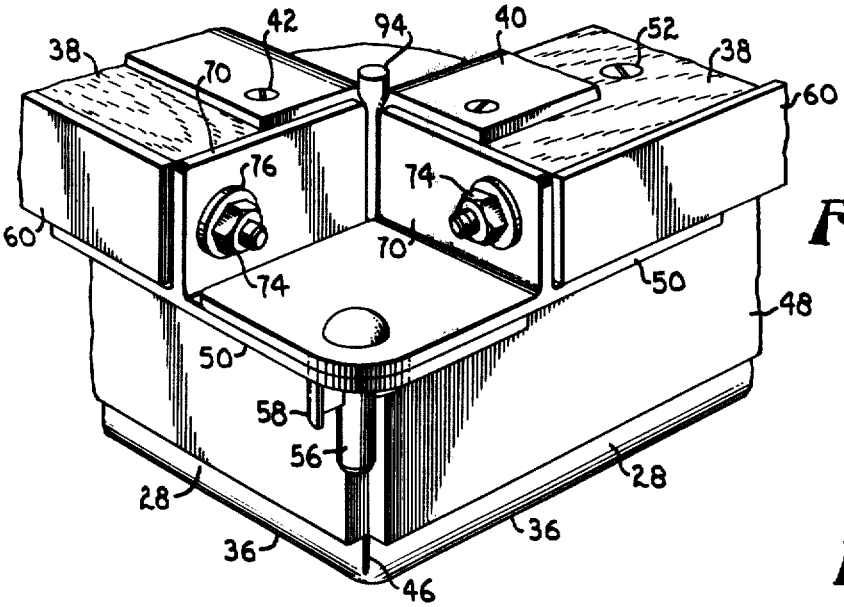
Fig. 5.
Fig. 6.
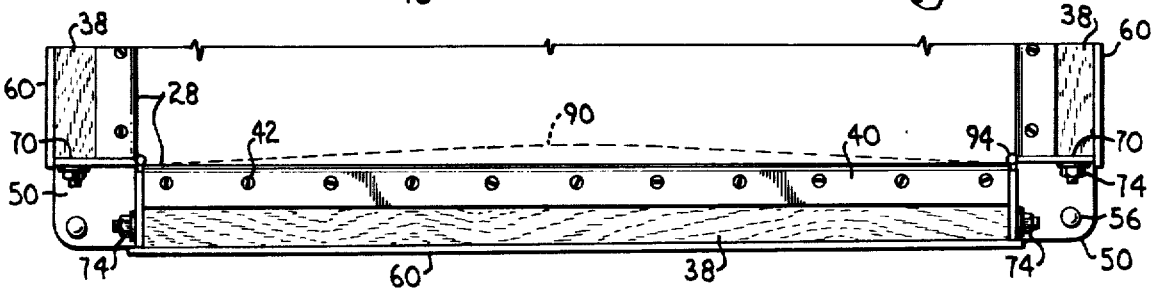

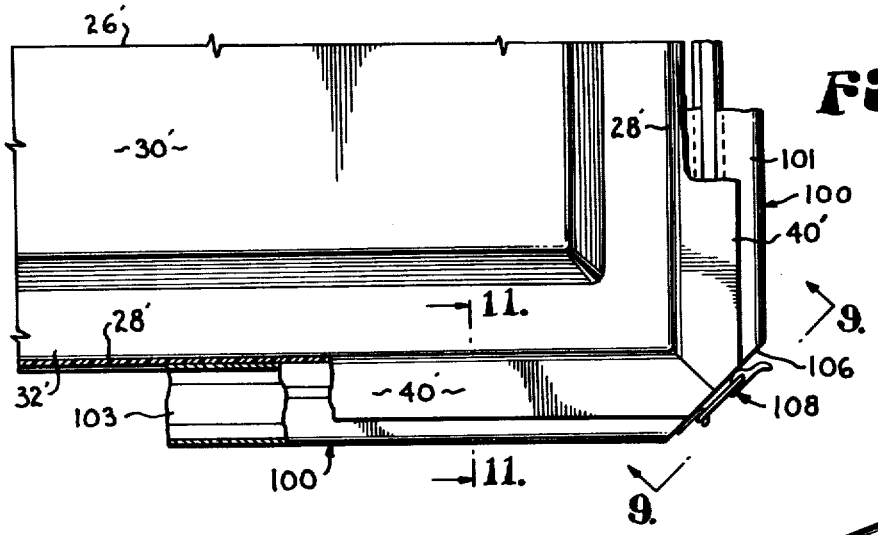
Fig. 8.
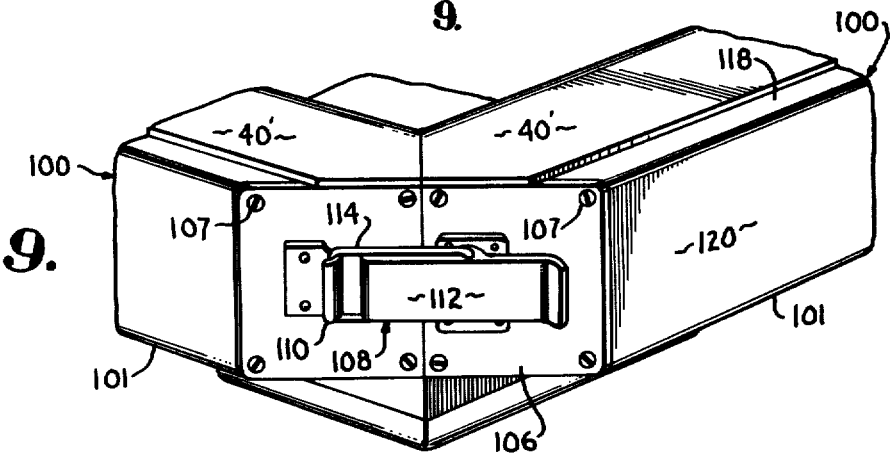
Fig. 9.
Fig. 10.
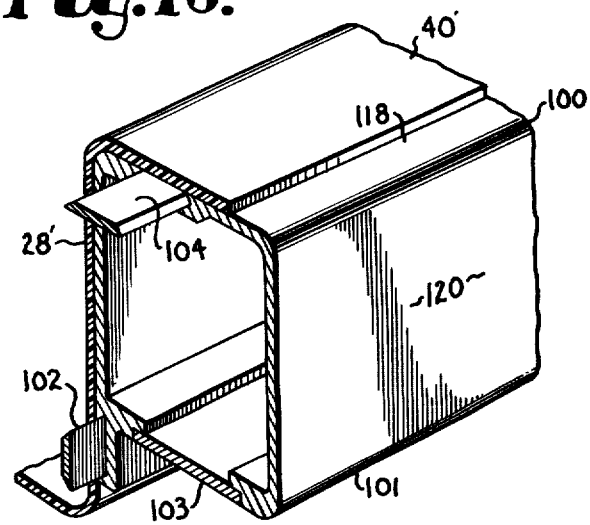
Fig. 11.
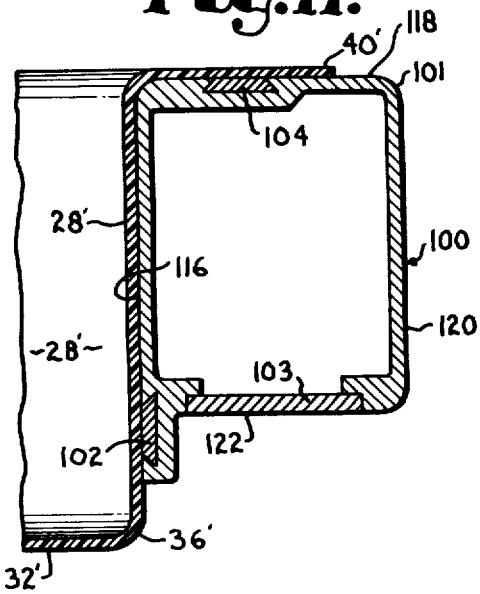

REINFORCED PLASTIC MOLD FOR CONCRETE PANELS

CROSS-REFERENCE

This application is a continuation in part of application Ser. No. 782,175, filed Mar. 28, 1977 now abandoned.

This invention relates to improvements in molds for forming precast structural units such as walls and floors and, in particular, to molds of this type having the advantages of light weight and portability, rapid stripping and resetting, and sufficient durability to provide many expected reuses.

In precast concrete wall and floor construction, waffle-shaped panels and slabs provide numerous advantages including a substantial saving in material, weight and money, as well as an architecturally advantageous three-dimensional configuration. Also, the waffle design offers complete freedom to fully insulate exterior walls, modular window units may be inserted in the voided areas of the waffle without sacrificing wall strength, and electrical wiring and plumbing runs can be installed after the building structure is erected. Many interior load-bearing walls and ceilings need only to be painted or textured to give a pleasing and economical open beam effect. Since the skin in the voided areas is relatively thin (as compared to the structural webs or ribs of the waffle), these areas are readily penetrated with drills and saws to facilitate plumbing and mechanical and electrical work.

Furthermore, the waffle design lends itself to the use of modular precast structural units that can be formed either at an in-plant location or at the site itself. For on-site production, it is important that the molds be lightweight and portable and easily stripped and reset for rapid production. Durability, reusability and simplicity are also important since the conveniences of a plant facility and in-plant production machinery are not available.

It is, therefore, an important object of the present invention to provide a mold for either in-plant production or on-site precasting of structural panels, which can be rapidly stripped and reset and reused numerous times.

Another important object of this invention is to provide a mold as aforesaid which is foolproof to operate and wherein release of the mold from the cured, molded product is accomplished without employing air pressure or other special equipment, thereby rendering the mold particularly adaptable to on-site production.

Still another important object of the invention is to provide such a mold which, though lightweight and readily portable, is durable and rigid in use and free from the possibility of dimensional errors in the molded product.

As a corollary to the preceding object, it is a specific and important aim of this invention to provide a mold for such panels in which the sides of the mold body have reinforcing rail members attached thereto that eliminate any tendency for a non-linear edge to be formed by the outward forces produced by the uncured material when the mold is filled.

Another specific and important aim of the invention is to provide rail members as aforesaid which, either by tuning the sides of the mold or by virtue of their rigid construction, counteract the outwardly directed forces against the sides produced when the mold is filled.

Still another important object of the invention is to provide a mold having a panel-forming mold body of flexible material, such as plastic, reinforced at its sides by rigid rail members of metal or other suitable material, wherein special joints are provided between the flexible sides and the rigid members to permit the mold body to expand and contract independently of the reinforcing members to reduce the risk of cracking or splitting during changes in temperature.

Yet another important object is to provide joints as aforesaid which also permit the mold body to be readily separated from the reinforcing members so that such body may be replaced after its useful life and the reinforcing members reused.

Furthermore, it is an important object of the present invention to provide a mold for forming precast waffle-shaped structural units wherein the waffle-forming mold body is a one-piece sheet of flexible material, such as a suitable plastic, which is specially reinforced to render the sheet material rigid and durable and prevent dimensional errors.

As a corollary to the immediately preceding object, it is an important aim of this invention to provide such a mold in which the sides of the mold body are pliable to present flaps swingable away from the molded product within the body to release such product therefrom.

Another specific and important aim is to provide a mold having pliable sides as aforesaid wherein the corners of the mold are open to permit such swinging movement and rapid stripping and resetting of the mold.

Still another important object is to provide an open-cornered mold as above wherein such corners are held closed during the molding process by simple locking devices that may be quickly released for stripping.

Yet another important object is to provide a one-piece mold body as aforesaid for forming precast waffle structures, wherein the void-forming portions of the sheet material are reinforced by a filler that imparts rigidity to such portions as well as reinforcing the same.

Other objectives of this invention include the provision of molds that may be readily cleaned and which have integral holdups on the pliable sides, and which have built-in supports for reinforcing bars to eliminate the need to use chairs or other types of supports separate from the mold itself, such built-in supports also forming electrical and plumbing raceways in the molded products.

In the drawings:

FIG. 1 is a perspective view of the mold of the present invention utilized in the production of precast waffle panels;

FIG. 2 is an enlarged fragmentary view (partially in elevation and partially in vertical cross-section) of the mold of FIG. 1 filled with concrete, one of the sides being shown swung outwardly to release the mold from the waffle panel;

FIG. 3 is a plan view of one corner of the mold of FIG. 1 on the same scale as FIG. 2, and shows the mold filled with concrete as in FIG. 2;

FIG. 4 is a greatly enlarged, exploded, detail view in perspective of one of the corners of the mold and the end of an associated reinforcing member;

FIG. 5 is a fragmentary, perspective view of the corner illustrated in FIG. 4 and on the same scale, and shows the corner locked closed during the molding process;

FIG. 6 is a fragmentary, plan view similar to FIG. 3 but showing an entire transverse side of the mold, the counteracting force of the tension strap being illustrated by the inwardly bowed, broken line;

FIG. 7 is a fragmentary, perspective view of an exemplary finished waffle panel formed by the mold of FIGS. 1–6 or 8–11;

FIG. 8 is a top plan view of one corner of a modified mold with parts broken away to reveal details of construction, such mold employing tubular reinforcing members fastened to the sides and outturned lips of the mold body by dovetail joints;

FIG. 9 is an enlarged, perspective view of the corner of the mold shown in FIG. 8, looking generally in the direction of the arrows 9—9;

FIG. 10 is a fragmentary, perspective view of a tubular reinforcing member attached to the mold body by dovetail joints as in FIG. 8;

FIG. 11 is an enlarged, cross-sectional view taken along line 11—11 of FIG. 8;

DETAILED DESCRIPTION

Figure 12:
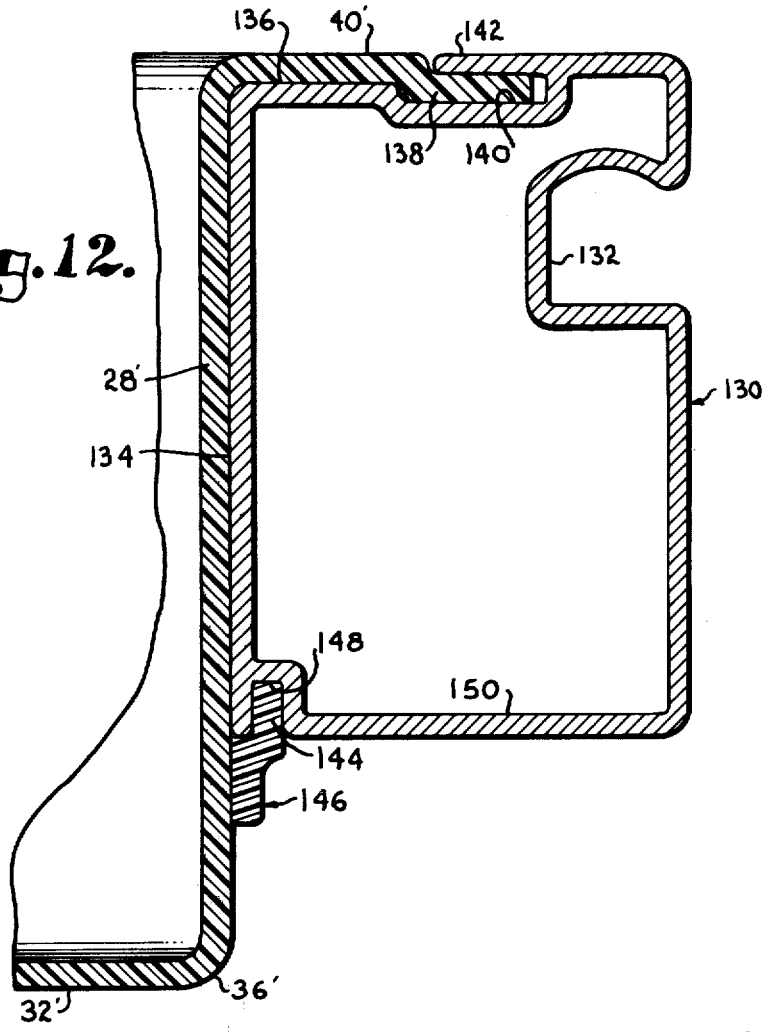
FIG. 12 is a view similar to FIG. 11 but on a larger scale, showing an alternative, tongue and groove joint arrangement.

Referring initially to FIG. 7, a precast waffle panel of the type produced by the mold of FIGS. 1–6 or 8–13 is illustrated. Such panel is a modular unit of reinforced concrete that may be employed either as a wall, roof or floor panel. Panels of this type are characterized by a relatively thin skin 20, thick structural sides 22 defining the periphery of the panel, and integral webs or ribs 24. The webs 24 are spaced apart at regular intervals to define voids 25 where the thickness of the panel resides solely in the skin 20. Manifestly, the presence of the voids 25 provides a substantial saving of material and reduction in weight, without significant sacrifice of strength due to the presence of the structural webs 24 and sides 22. Typically, each panel is 8 feet in its transverse dimension, 12 feet long, and 8 inches thick at the sides 22 and webs 24. With a 2-inch thickness for the skin 20, the panel utilizes less than half of the concrete used in a solid 8-inch wall, roof or floor.

Now referring to FIGS. 1–6, the mold of the present invention employs a one-piece mold body having a panel-forming component 26 and four integral sides 28. The entire mold body constituting the component 26 and sides 28 is formed from a single sheet of flexible material, such as a thermoformed ABS plastic. In order to impart the requisite waffle shape to the molded product, the forming component 26 is provided with spaced, raised portions 30. As an example, twelve such portions 30 in two rows of six each are illustrated in FIG. 1. Each of the portions 30 gives the appearance of a platform elevated above a base lattice 32 (see FIG. 2) which forms a grid at the bottom of the mold.

Each raised portion 30, by virtue of the use of a single piece of plastic sheet material, presents a downwardly facing cavity which is filled by a rigid plastic form 34. This structurally reinforces the component 26 and rigidifies the raised portions 30, and also insulates the mold to assist in curing.

The two longitudinal and two transverse sides 28 are pliable due to the flexible nature of the plastic sheet material and, therefore, present flaps swingable about lines of bend 36 at the merger of the sides 28 with the outside edges of the lattice or grid portion 32 of the mold body. Each of the sides 28 is reinforced by a rail member 38 composed of an appropriate length of 2 by 4 lumber stock. Each side 28 is secured to the associated reinforcing member 38 as best seen in FIG. 4; the upper edge of the side 28 presents an outturned lip 40 attached to the member 38 by wood screws 42. It should be noted that each end 44 of the member 38 is even with the corresponding end edge 46 of the side 28 to which it is secured. Identical construction is employed at each end 44 of each of the four members 38 on the four sides 28 of the mold body. For additional reinforcement and rigidity, a plywood strip 48 extends the length of each of the sides 28 and is the full width of the side from top to bottom, the upper longitudinal edge portion of each strip 48 being sandwiched between the associated side 28 and member 38.

It may be appreciated that the end edges 46 of the sides 28 are free end edges and that, therefore, the mold body is provided with open corners so that the sides 28 may swing outwardly as set forth above from normal, molding positions closing the corners, as illustrated for the left side 28 as viewed in FIG. 2. During molding, each corner is held closed by a locking device best illustrated in FIGS. 4 and 5. Each end 44 of each reinforcing member 38 has a corner plate 50 secured thereto by three bolts 52 that extend through aligned holes in the member 38 and plate 50. A tongue is presented by the plate 50 extending longitudinally outwardly from the member 38, such tongue having an opening 54 therein for the purpose of receiving a locking pin 56 which is inserted through the opening 54 and a corresponding opening 54 in the adjacent corner plate 50 upon alignment of such openings. The locking pin 56 is securely held by a wedge 58 that is inserted through a cross-opening in the pin 56; thus the locking pin is in the nature of a wedge bolt that securely holds the two tongues in overlapping engagement with each other as is clear in FIG. 5.

In order to counteract the tendency of the sides 28 to bow outwardly under the high forces applied when the mold is filled with concrete, a tension strap 60 extends the length of each of the reinforcing members 38 and bears flat against the outer longitudinal edge 62 thereof. Such edge 62 is slotted at 64 at each end 44 of the member 38 to receive a threaded stud 66 welded to a lug 68 on the inner face of the strap 60 adjacent the end thereof. An upstanding flange 70 on the corner plate 50 butts against the end 44 of the member 38 and has an opening 72 therein through which the stud 66 extends in a direction longitudinally of the member 38. A nut 74 and washer 76 on the outer end portion of the stud 66 bear against the flange 70 and complete the tension adjustment assembly.

Referring to FIG. 2, transverse ridges 78 are formed in the base lattice portion 32 of the mold body to provide built-in supports for reinforcing bars (rebar) illustrated at 80. As may be seen in FIG. 7, the ridges 78 and similar ridges spaced along the lattice cause notches 82 to be formed in the sides 22 and ribs 24 of the molded product. Besides providing a convenient means for supporting rebar without the need to employ chairs, the interior notches 82 intercommunicate adjacent voids 26 and thus also serve as electrical and plumbing raceways.

In the mold body, the ridges between pairs of adjacent raised portions 30 communicate at their ends with the corresponding foam-filled cavities, thereby leaving the open notches 82 in the webs 24 of the molded product. The ridges 78 seen in FIG. 2 are open at their inner ends only since they are located at the side-forming portions of the mold.

Circular projections 84 are attached to the inside faces of the sides 28 (FIG. 2) and are spaced along the sides to provide holdups for parts that are to be held in place while the concrete is poured into the mold. In particular, each of the holdups 84 is utilized to support a short section of pipe 86 that extends across the mold to form a through hole for bolts employed to assemble the finished panels into the desired structure. Such through holes are illustrated at 88 in FIG. 7.

In use, the inherent light weight and portability of the mold of FIGS. 1–6 make it ideal for on-site production of precast panels, and the simple, foolproof operation together with the reusable nature of the mold render it also suitable for in-plant production as well. With the sides 28 closed and the locking pins 56 in place, the mold is filled with concrete in the usual manner. The nuts 74 at the ends of each of the tension straps 60 are adjusted as necessary to prevent the sides 28 from bowing outwardly. The effect of each strap 60 on its associated reinforcing member 38 is illustrated by the broken line 90 in FIG. 6, which depicts the inward bowing (exaggerated) of the member 38 and side 28 before the mold is filled. Accordingly, the nuts 74 are adjusted such that, once the concrete is present, the outwardly directed forces against the side 28 are exactly counteracted by the inwardly directed forces applied by the tension strap 60. This assures that the edges of the finished panel will be straight and true and that dimensional errors will not be introduced into the product.

Once the concrete is cured, the mold is stripped by removing the four locking pins 56 and pulling the four sides 28 away from the molded product. Since the sides 28 become pliable flaps once the locking devices are released, they swing readily about the lines of bend 36 to permit the casting to be quickly pulled from the mold. It may also be appreciated that prying the sides 28 away from the casting simultaneously pulls the holdups 84 clear so that the holes 88 are accessible.

The mold structure as described above and illustrated herein may be reused many times; molds of this type in present use have hundreds of expected reuses. Accordingly, though of lightweight construction, the mold is extremely durable. Note that reinforcement as desired may be used in the concrete in addition to the rebar 80 placed on the ridges 78 of the mold, as illustrated in FIG. 2 by paving mesh 92 approximately centered in the skin portion 20 of the product. To seal the small gap in each corner of the mold, a rubber strip 94 may be employed.

Referring to FIGS. 8–11, the mold of FIGS. 1–6 is modified by replacing the rail members 38 of FIGS. 1–6 with box members 100 which are of tubular construction and are preferably formed from aluminum extrusions. Each of the box members 100 is of sufficient structural strength to prevent outward bowing of the sides of the mold body which would otherwise occur when the mold is filled with concrete.

The mold body used in FIGS. 8–11 is identical to the mold body of FIGS. 1–6 and has a panel-forming component 26' and four integral sides 28'. The upper edge of each side 28' presents an outturned lip 40'. Each of the reinforcing box members 100 as illustrated is formed by an aluminum extrusion 101 of inverted, U-shaped configuration (FIG. 11) in which a separate bottom plate 103 is inserted to complete the construction. The box member thus is of rectangular configuration and presents outward faces 116, 118, 120 and 122. The side face 116 of each box member 100 abuts the outside of the associated side 28' and the top face 118 abuts the underneath side of outturned lip 40'.

As discussed above, the mold body is formed from a sheet of flexible material such as ABS plastic. Glued to each side 28' adjacent its lower edge is a longitudinally extending, dovetail strip 102 likewise composed of the same plastic material. Similarly, a longitudinal dovetail strip 104 is glued or bonded to the underneath side of each outturned lip 40'. Aligned, mating grooves in each of the faces 116 and 118 of each of the box members 100 receive the respective dovetail strips 102 and 104. The longitudinal joints thus formed permit relative longitudinal movement of each of the sides 28' and the box member 100 thereon as the sides and box members expand and contract with changes of temperature. This is important since the coefficient of expansion of ABS plastic, for example, is substantially different than the coefficient of expansion of the aluminum; therefore, if the sides of the mold body were not relatively free to expand and contract independently of the box members in response to substantial changes in environmental temperature, the mold body would be subject to possible cracking and splitting. This risk is considerably reduced by the dovetail joints since independent longitudinal movement of the sides 28' and members 100 is permitted.

In the modification of the present invention as shown in FIGS. 8–11, the locking devices employed in FIGS. 1–6 as best illustrated in FIGS. 4 and 5 are replaced with locking devices as best shown in FIG. 9. The box members 100 are elongated and extend along the outside of the body of the mold as in FIGS. 1–6. Each of the members 100 has a pair of opposed ends terminating adjacent the end edges of the associated side 28'. At each corner the ends of both members 100 terminate at 45° angles and are mitered together when the locking devices discussed below are engaged.

Each of the box reinforcing members 100 is hollow and tubular as is evident. At each corner of the mold body, an opening formed by a bevel on the upper and lower faces 118 and 122 of each member 100 from the outer side face 120 thereof to the miter joint is sealed by an end cap plate 106 which is rigidly mounted on such end of the member 100 by screws 107 threaded through the plate 106 into the member. The bevels on adjacent ends are aligned when the corners are closed as in FIG. 8; therefore, the two cap plates 106 are disposed edge-to-edge in perpendicular relationship to the closed miter joint.

As seen in FIG. 9, a latch 108 of a conventional type serves as the locking device which secures the adjoining ends of the box members together at each of the corners of the mold body. The latch 108 includes a hook portion 110 rigidly mounted on the left end cap plate 106, and a cam acting lever 112 mounted on the right end cap plate 106 and which carries a bail 114. With the lever 112 shifted to the left from its locked position shown in FIG. 9 and the bail 114 looped over the hook 110, the lever is shifted back to the right to its FIG. 9 position to draw the ends of the two members 100 tightly together and form the miter joint. To release the latch 108 the lever 112 is once again shifted to the left until the bail 114 can be disengaged from the hook 110.

The modification as shown in FIGS. 8–11 eliminates the need for the tension straps employed in conjunction with the reinforcing members of FIGS. 1–6. Moreover, when a mold body wears out, each of the box members 100 can be separated from the mold body and reused by removing one of the end caps 106 from each box member and sliding the member longitudinally along the dovetail strips 102 and 104 until it is completely disengaged therefrom. The same reinforcing members can then be reinstalled on a new mold body by engaging the grooved portions of faces 116 and 118 of each of the box members 100 with the dovetail strips 102 and 104 of the new body.

Figure 13:
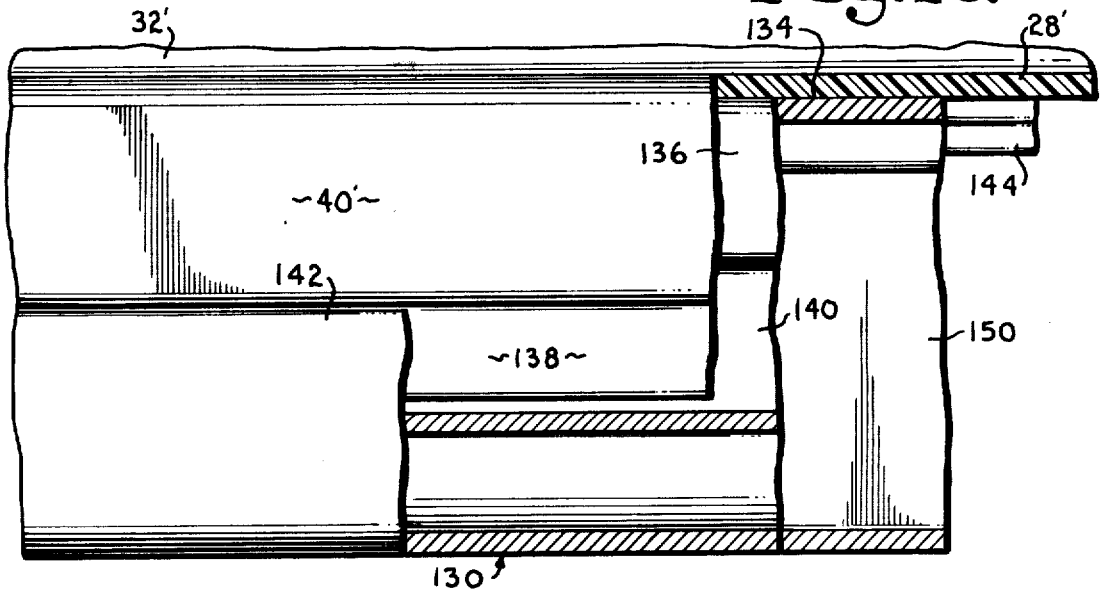
FIG. 13 is a fragmentary, plan view on the same scale as FIG. 11 and shows one side of a mold employing the tongue and groove joints, parts being broken away to reveal details of construction.

An alternative form of longitudinal expansion joint is illustrated in FIGS. 12 and 13 where one of the sides 28' of the mold body and associated reinforcing member 130 are illustrated in detail. The box member 130 is also preferably an aluminum extrusion and is shown as a one-piece extrusion having a longitudinal recess 132 in its outer side which serves as a finger hold for lifting and carrying the mold, and which can also facilitate the clipping or clamping of an insulated cover (not shown) over the mold body. As in FIGS. 8–11, the inner side face 134 of the box member 130 abuts the outside of the associated side 28' and the inner margin 136 of the top face thereof underlies the outturned lip 40'.

However, the lip 40' in FIGS. 12 and 13 is specially formed at its marginal edge to present a generally Z-shaped tongue 138 that is received within a mating groove 140 recessed in the top wall of the box member 130. It should be noted that the groove 140 is presented by a horizontal slot beneath a longitudinally extending lip portion 142 of the top wall of the member 130, and that the recessed disposition of the groove 140 causes the Z-shaped tongue 138 to be captured within the groove such that withdrawal therefrom is precluded. The bottom of the groove 140 is below the plane of the margin 136, and the top of the groove is defined by the undersurface of the lip portion 142.

A second generally Z-shaped tongue 144 is provided by a longitudinal plastic strip 146 which may be glued to side 28' by a solvent type cement or held thereon by screws (not shown) if desired. The upstanding tongue 144 formed by the strip 146 is received within a mating longitudinal groove 148 in the bottom 150 of the box member 130, such groove 148 being presented by the shape of the extrusion and located at the lower, inner corner of the member 130 where the bottom 150 merges with the inner side wall thereof.

In utilizing the tongue and groove expansion joint arrangement of FIGS. 12 and 13, the longitudinal strips 146 may be prelocated on the sides 28' or attached after the box members 130 are installed on the lips 40'. The latter approach is preferred since the possibility of improperly locating the strips 146 is eliminated. Each box member 130 is installed on the associated side 28' by inserting of the Z-shaped tongue 138 into the recessed groove 140 until the member is fully seated with its faces 134 and 136 in contact with the side 28' and lip 40'. The Z-shaped tongue 144 is then inserted into the lower groove 148 and the strip 146 is attached to the side 28' by cement or screws. As in the dovetail joint arrangement of FIGS. 8–11, each of the box members 130 is readily separated from a worn-out mold body and reused by sliding the member longitudinally along the side 28' until it is completely disengaged from the tongues 138 and 144.

An advantage of the tongue and groove expansion joints of FIGS. 12 and 13 is that manufacturing tolerances are not as high as required with the dovetail expansion joints. Therefore, assembly of the mold is more foolproof and less labor is required. As in the dovetail joint construction, the strips 146 should be of the same material as the mold body (or composed of a material having substantially the same coefficient of expansion as the material of the mold body) so that the sides 28' and strips 146 will expand and contract longitudinally to the same degree.

Having thus described my invention, what is claimed as new and desired to be secured by Letters Patent is:

1. A mold for forming precast panels, said mold comprising:

a one-piece mold body of flexible material configured to impart a desired shape to a molded product formed therein, said body having a panel-forming component provided with a plurality of integral sides presenting the periphery of the body, said sides having free end edges to present pliable flaps swingable on said component outwardly from normal, molding positions and away from a molded product within the mold body to permit said product to be withdrawn therefrom, the free end edges of adjacent sides defining closed corners of the body when said sides are in their normal positions and, upon said outward swinging movement of the sides, said edges separating to cause said corners to open;

a plurality of elongated reinforcing members on corresponding sides extending therealong on the outside of said body, each of said members being secured to the corresponding side for movement therewith as said corners are opened and closed, and said members being constructed and arranged to prevent outward bowing of said sides when the mold body is filled with a material to be cast; and releasable means associated with said edges for holding the corners closed to maintain said sides in their normal positions during the molding process.

2. The mold as claimed in claim 1, wherein said body is a sheet of plastic material.

3. The mold as claimed in claim 1, wherein each of said members has a pair of opposed ends terminating adjacent the end edges of the associated side, said releasable means including a plurality of locking devices for joining the ends of adjacent members.

4. The mold as claimed in claim 3, wherein each of said locking devices includes a pair of corner plates secured to respective ends of the associated members, said plates having openings therethrough in alignment with each other when the corner is closed, and a locking pin receivable in said openings upon alignment thereof.

5. The mold as claimed in claim 3, wherein each of said locking devices includes a pair of end caps secured to respective ends of the associated members, and a latch having interengageable parts on said end caps for holding the corner closed.

6. The mold as claimed in claim 1, wherein said body comprises a sheet of flexible material and said panel-forming component thereof is configured to impart a waffle-like appearance to a molded product formed in said body, said component having spaced-apart, void-forming, raised portions presenting downwardly facing cavities, there being a filler material in said cavities to reinforce said component and rigidify said raised portions thereof.

7. The mold as claimed in claim 6, wherein said filler material is a rigid foam.

8. The mold as claimed in claim 1, further comprising a number of holdups on at least certain of said sides, each holdup being attached to and projecting inwardly from the side upon which it is disposed.

9. The mold as claimed in claim 1, wherein said body comprises a sheet of plastic material and said panel-forming component thereof is configured to impart a waffle-like appearance to a molded product formed in said body, said component having spaced-apart, void-forming, raised portions and a base lattice extending between said raised portions for forming structural webs in the molded product, said lattice being provided with a number of transverse ridges for supporting reinforcing bars and the like cast in the molded product, said raised portions presenting downwardly facing cavities and said supporting ridges communicating with corresponding cavities to present notches in the webs of the molded product that serve as electrical and plumbing raceways.

10. A mold for forming precast panels, said mold comprising:

a one-piece mold body of flexible, plastic sheet material configured to impart a desired shape to a molded product formed therein, said body having a panel-forming component provided with a plurality of integral sides presenting the periphery of the body, said sides having free end edges to present pliable flaps swingable on said component outwardly from normal, molding positions and away from a molded product within the mold body to permit said product to be withdrawn therefrom, the free end edges of adjacent sides defining closed corners of the body when said sides are in their normal positions and, upon said outward swinging movement of the sides, said edges separating to cause said corners to open;

releasable means associated with said edges for holding the corners closed to maintain said sides in their normal positions during the molding process;

a plurality of elongated reinforcing members on corresponding sides extending substantially the length thereof on the outside of said body; and tunable means on said members for applying inwardly directed forces thereto of selected magnitude to counteract outwardly directed forces against said sides produced when the mold body is filled.

11. A mold for forming precast panels, said mold comprising:

a one-piece mold body of flexible, plastic sheet material configured to impart a desired shape to a molded product formed therein, said body having a panel-forming component provided with a plurality of integral sides presenting the periphery of the body, said sides having free end edges of present pliable flaps swingable on said component outwardly from normal, molding positions and away from a molded product within the mold body to permit said product to be withdrawn therefrom, the free end edges of adjacent sides defining closed corners of the body when said sides are in their normal positions and, upon said outward swinging movement of the sides, said edges separating to cause said corners to open;

releasable means associated with said edges for holding the corners closed to maintain said sides in their normal positions during the molding process;

a plurality of elongated reinforcing members on corresponding sides extending substantially the length thereof on the outside of said body, said members being composed of a rigid material having a coefficient of expansion substantially different from the coefficient of expansion of the plastic material of said body; and means between each of said sides and the corresponding member for joining the sides to the members and permitting relative longitudinal movement of the sides and members as the same expand and contract with changes in temperature.

12. The mold as claimed in claim 11, wherein said sides are provided with outturned lips and said members present outer faces abutting respective sides and lips, said joining means securing said sides and lips to corresponding faces of said members.

13. The mold as claimed in claim 12, wherein said joining means includes joint elements on said sides and lips extending longitudinally thereof and composed of a material having substantially the same coefficient of expansion as the material of said body, and mating longitudinal joint elements on said members.

14. A mold for forming precast panels, said mold comprising:

a one-piece mold body of flexible material having a panel-forming component provided with a plurality of integral sides presenting the periphery of the body, said sides having free end edges to present pliable flaps swingable on said component outwardly from normal, molding positions and away from a molded product within the mold body to permit said product to be withdrawn therefrom, the free end edges of adjacent sides defining closed corners of the body when said sides are in their normal positions and, upon said outward swinging movement of the sides, said edges separating to cause said corners to open;

releasable means associated with said edges for holding the corners closed to maintain said sides in their normal positions during the molding process; and a plurality of elongated reinforcing members on corresponding sides extending substantially the length thereof on the outside of said body, and an elongated tension strap on each of said members for applying inwardly directed forces thereto to counteract outwardly directed forces against said sides produced when the mold body is filled.

15. The mold as claimed in claim 14, wherein each of said members presents an outer longitudinal edge, each of said straps extending along said edge of the corresponding member.

16. The mold as claimed in claim 15, wherein each of said straps has a pair of opposed ends adjacent corresponding edges of the associated side, there being means connected to each of said ends and engaging the associated member for adjusting the tension of the strap.

17. A mold for forming precast panels, said mold comprising:

a one-piece mold body of flexible material having a panel-forming component provided with a plurality of integral sides presenting the periphery of the body, said sides having free end edges to present pliable flaps swingable on said component outwardly from normal, molding positions and away from a molded product within the mold body to permit said product to be withdrawn therefrom, the free end edges of adjacent sides defining closed corners of the body when said sides are in their normal positions and, upon said outward swinging movement of the sides, said edges separating to cause said corners to open;

releasable means associated with said edges for holding the corners closed to maintain said sides in their normal positions during the molding process;

a plurality of elongated reinforcing members on corresponding sides extending substantially the length thereof on the outside of said body; and a longitudinally extending joint between each of said sides and the corresponding member for interconnecting the same and permitting said body to expand and contract independently of said members during changes in temperature.

18. The mold as claimed in claim 17, wherein each joint includes a pair of mated joint elements on the respective side and member and extending longitudinally thereof.

19. The mold as claimed in claim 17, wherein said members are of tubular, metallic construction and have sufficient structural strength to resist deformation under outwardly directed forces against said sides produced when the mold body is filled.

20. A mold for forming precast panels, said mold comprising:

a one-piece mold body of flexible material having a panel-forming component provided with a plurality of integral sides presenting the periphery of the body, said sides having free end edges to present pliable flaps swingable on said component outwardly from normal, molding positions and away from a molded product within the mold body to permit said product to be withdrawn therefrom, the free end edges of adjacent sides defining closed corners of the body when said sides are in their normal positions and, upon said outward swinging movement of the sides, said edges separating to cause said corners to open;

releasable means associated with said edges for holding the corners closed to maintain said sides in their normal positions during the molding process;

a plurality of elongated reinforcing members on corresponding sides extending substantially the length thereof on the outside of said body; and a longitudinally extending dovetail joint between each of said sides and the corresponding member for interconnecting the same and permitting said body to expand and contract independently of said members during changes in temperature, each joint including a pair of mated dovetail joint elements on the interconnected side and member and extending longitudinally thereof.

21. A mold for forming precast panels, said mold comprising:

a one-piece mold body of flexible material having a panel-forming component provided with a plurality of integral sides presenting the periphery of the body, said sides having free end edges to present pliable flaps swingable on said component outwardly from normal, molding positions and away from a molded product within the mold body to permit said product to be withdrawn therefrom, the free end edges of adjacent sides defining closed corners of the body when said sides are in their normal positions and, upon said outward swinging movement of the sides, said edges separating to cause said corners to open;

releasable means associated with said edges for holding the corners closed to maintain said sides in their normal positions during the molding process;

a plurality of elongated reinforcing members on corresponding sides extending substantially the length thereof on the outside of said body; and a longitudinally extending joint between each of said sides and the corresponding member for interconnecting the same and permitting said body to expand and contract independently of said members during changes in temperature, each joint including a pair of mated tongue and groove elements on the interconnected side and member and extending longitudinally thereof, the tongue element of each joint having a generally Z-shaped configuration and the mating groove element being disposed to preclude withdrawal of the tongue element upon insertion thereinto.

* * * * *